US008109245B2

(12) United States Patent
Tateno

(10) Patent No.: US 8,109,245 B2
(45) Date of Patent: Feb. 7, 2012

(54) VARIABLE VALVE APPARATUS

(75) Inventor: Manabu Tateno, Sunto-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 278 days.

(21) Appl. No.: 12/598,203

(22) PCT Filed: Jun. 11, 2008

(86) PCT No.: PCT/JP2008/061075

§ 371 (c)(1),
(2), (4) Date: Oct. 30, 2009

(87) PCT Pub. No.: WO2008/153191

PCT Pub. Date: Dec. 18, 2008

(65) Prior Publication Data

US 2010/0126446 A1 May 27, 2010

(30) Foreign Application Priority Data

Jun. 14, 2007 (JP) ..... 2007-157802

(51) Int. Cl.
*F01L 1/34* (2006.01)

(52) U.S. Cl. ..... 123/90.16; 123/90.39; 74/559

(58) Field of Classification Search ..... 123/90.16, 123/90.39; 74/559, 569
See application file for complete search history.

(56) References Cited

U.S. PATENT DOCUMENTS

| | | | | |
|---|---|---|---|---|
| 4,256,070 | A | 3/1981 | Mueller | |
| 4,337,738 | A | 7/1982 | Bubniak et al. | |
| 7,377,241 | B2 * | 5/2008 | Hirano | 123/90.16 |
| 2004/0231625 | A1 | 11/2004 | Sugiura et al. | |
| 2006/0102119 | A1 | 5/2006 | Gecim et al. | |
| 2006/0260574 | A1 | 11/2006 | Schon et al. | |
| 2007/0028876 | A1 | 2/2007 | Fujita | |

FOREIGN PATENT DOCUMENTS

| | | |
|---|---|---|
| DE | 10 2005 050 894 A1 | 4/2007 |
| EP | 1 387 048 | 2/2004 |
| EP | 1 728 980 | 12/2006 |
| JP | 08 061031 | 3/1996 |
| JP | 2004 100555 | 4/2004 |
| WO | 2004 085804 | 10/2004 |
| WO | 2005 026503 | 3/2005 |
| WO | WO 2006/025565 A1 | 3/2006 |

OTHER PUBLICATIONS

Office Action issued Feb. 22, 2011, in Japanese Patent Application No. 2007-157802.
Office Action issued Jun. 24, 2011 in German Application No. 11 2008 001 030.7 (With English Translation).

* cited by examiner

*Primary Examiner* — Zelalem Eshete
(74) *Attorney, Agent, or Firm* — Oblon, Spivak, McClelland, Maier & Neustadt, L.L.P.

(57) ABSTRACT

A drive cam opens or closes an intake valve via a variable mechanism, a split-type rocking cam arm, and a valve actuating mechanism. The variable mechanism varies a position of an intermediate roller corresponding to a rotating angle of a control shaft, thereby variably setting a lift amount of the intake valve. The split-type rocking cam arm includes an input arm and an output arm, and a connection selection mechanism is disposed between the arms. When the arms are connected together, the intake valve performs an ordinary open/close operation. When the arms are disconnected, an input of the drive cam is absorbed by a relative rocking motion between the arms, so that the intake valve is retained in a pause state.

10 Claims, 12 Drawing Sheets

VARIABLE VALVE APPARATUS

TECHNICAL FIELD

The present invention relates generally to variable valve apparatus well adapted for use in internal combustion engines and the like. More particularly, the present invention relates to a variable valve apparatus that allows a lift amount of a valve body to be variably set.

BACKGROUND ART

A known variable valve apparatus, as that disclosed, for example, in Patent Document 1 (JP-A-2004-100555), is capable of variably setting a lift amount of a valve body. The variable valve apparatus of the known art includes a linkage mechanism having a plurality of link parts connected with each other. The linkage mechanism includes an input arm and a rocking arm. Specifically, the input arm receives an input from a drive cam. The rocking arm rocks a rocker arm on a side of the valve body. The input arm is held at all times in a position in contact with the drive cam by an urging force of a spring. The rocking arm is fixed to a rotatable control shaft, so that the rocking arm changes a position thereof (an inclined angle) in accordance with a rotating angle of the control shaft.

The linkage mechanism having arrangements as described above translates the input from the drive cam to a corresponding rocking motion of the rocking arm and further transmits the rocking motion to the rocker arm, so that the valve body is opened or closed. At this time, the linkage mechanism varies the inclined angle of the rocking arm according to the rotating angle of the control shaft and the inclined angle is reflected in amplitude of the rocker arm. As a result, the variable valve apparatus can continuously vary the lift amount of the valve body according to the rotating angle of the control shaft.

Including the above-mentioned document, the applicant is aware of the following document as a related art of the present invention.

[Patent Document 1] JP-A-2004-100555

DISCLOSURE OF INVENTION

There is a need, during operation of an internal combustion engine, for temporarily stopping an open/close operation of the valve body by setting the lift amount of the valve body to zero. In this case, in accordance with the variable valve apparatus of the known art, the valve body can be made to pause in a closed position by rotating the control shaft to a position, at which the lift amount is zero.

In the known variable valve apparatus, however, a process of a gradual decrease in the lift amount in accordance with the rotating angle of the control shaft occurs during a period of time that begins when rotation of the control shaft is started for making the valve body pause and ends when the actual lift amount becomes zero. Specifically, there is in the known art a problem in that the valve body cannot be brought to a stop quickly from any given lift amount. Similarly, it is difficult with the known art to return the valve body in a pause state quickly to any given lift amount.

The present invention has been made to solve the foregoing problems of the known art and it is an object of the present invention to provide a variable valve apparatus capable of bringing a valve body to a pause state, and canceling the pause state, quickly at any given lift amount, while continuously varying the lift amount of the valve body.

The above object is achieved by a variable valve apparatus which comprise a control shaft rotated for controlling a lift amount of a valve body. The variable valve apparatus comprise a variable mechanism disposed displaceably near a drive cam, the variable mechanism following a profile of the drive cam at a position corresponding to a rotating angle of the control shaft to make a reciprocating motion.

The variable valve apparatus comprise a split-type rocking mechanism including an input member receiving the reciprocating motion of the variable mechanism to make a rocking motion and an output member outputting the rocking motion of the input member, the input member and the output member being mutually connectable or disconnectable.

The variable valve apparatus comprise a connection selection mechanism selecting a connected or disconnected state between the input member and the output member of the split-type rocking mechanism. And the variable valve apparatus comprise a valve actuating mechanism translating the rocking motion outputted from the output member of the split-type rocking mechanism to a corresponding open or close operation of the valve body.

In a second aspect of the present invention, the input member and the output member of the split-type rocking mechanism according to the first aspect of the present invention may be rockably mounted on an outer peripheral side of the control shaft.

In a third aspect of the present invention, the split-type rocking mechanism may be formed symmetrically on both sides about a plane perpendicular to the control shaft.

In a fourth aspect of the present invention, the input member may include an input side abutment portion, against which the variable mechanism abuts. And the input member may also include two outer support portions rockably supported by the control shaft on both sides of the input side abutment portion. On the other hand, the output member may include an output side abutment portion abutting against the valve actuating mechanism at a position overlapping the input side abutment portion. And the output member may also include an inner support portion rockably supported by the control shaft between the outer support portions of the input member.

In a fifth aspect of the present invention, the valve body, the split-type rocking mechanism, the connection selection mechanism, and the valve actuating mechanism may be each disposed on a first side and a second side of the control shaft in an axial direction of the control shaft. And, the variable mechanism may include an arm portion disposed on the outer peripheral side of the control shaft between the split-type rocking mechanism on the first side and the split-type rocking mechanism on the second side, a cam roller disposed at a leading end side of the arm portion, the drive cam abutting against the cam roller, and two intermediate rollers disposed at the leading end side of the arm portion on both sides of the cam roller, each of the two intermediate rollers abutting against the split-type rocking mechanism on the first side and the split-type rocking mechanism on the second side, respectively.

In a sixth aspect of the present invention, the valve body, the split-type rocking mechanism, the connection selection mechanism, and the valve actuating mechanism may be disposed on a first side of the control shaft in an axial direction of the control shaft.

The valve body and the valve actuating mechanism, together with a non-split-type rocking mechanism may be disposed on a second side of the control shaft in the axial direction of the control shaft.

The variable mechanism may include an arm portion disposed on the outer peripheral side of the control shaft between the split-type rocking mechanism on the first side and the non-split-type rocking mechanism on the second side, a cam roller disposed at a leading end side of the arm portion, the drive cam abutting against the cam roller, and two intermediate rollers disposed at the leading end side of the arm portion on both sides of the cam roller, each of the two intermediate rollers abutting against the split-type rocking mechanism on the first side and the non-split-type rocking mechanism on the second side, respectively.

In a seventh aspect of the present invention, the connection selection mechanism normally retains a connected state between the input member and the output member and cancels the connected state when driven externally.

In an eighth aspect of the present invention, the valve body may be mounted in an internal combustion engine. The connection selection mechanism may be driven by a hydraulic pressure generated when the internal combustion engine operates.

In a ninth aspect of the present invention, the connection selection mechanism may include an engagement hole disposed in either one of the input member and the output member. The connection selection mechanism may also include a movable pin displaceably disposed in the other one of the input member and the output member, the movable pin being engaged with or disengaged from the engagement hole. At this time, the retention means normally retaining the movable pin in a state of being engaged with the engagement hole. Also, the disengagement means disengaging the movable pin from the engagement hole against the retention means when a hydraulic pressure is supplied.

In a tenth aspect of the present invention, the engagement hole and the movable pin are disposed at positions, at which each opposes each other, when the input member and the output member make a rocking motion relative to each other, within a range of the rocking motion.

In an eleventh aspect of the present invention, the connection selection mechanism may be a hydraulically-operated mechanism disposed between the input member and the output member. The control shaft includes a first oil path, to which a hydraulic pressure is supplied from a hydraulic pressure source may also be provided. The split-type rocking mechanism may include a second oil path connected with the first oil path, the second oil path supplying the connection selection mechanism with the hydraulic pressure.

In a twelfth aspect of the present invention, the split-type rocking mechanism may include an input side urge means urging the input member toward the variable mechanism and an output side urge means urging the output member toward the valve actuating mechanism.

In accordance with the first aspect of the present invention, when the input member and the output member of the split-type rocking mechanism are in a connected state, the input of the drive cam is transmitted to the valve body via the variable mechanism, the split-type rocking mechanism, and the valve actuating mechanism, which allows the valve body to be opened or closed. At this time, the variable mechanism can vary an amplitude of the rocking motion of the split-type rocking mechanism corresponding to the rotating angle of the control shaft, so that a lift amount of the valve body can be variably set. The connection selection mechanism can cancel the connected state between the input member and the output member as necessary. In a condition, in which the connected state is canceled, the input of the drive cam is absorbed between the input member and the output member, so that the input is not transmitted to the valve body side. The valve body can therefore be brought to a pause.

In this case, the connection selection mechanism can connect, or disconnect, the input member and the output member regardless of the variable mechanism varying the lift amount of the valve body. Accordingly, the connection selection mechanism can quickly bring the valve body operating with any given lift amount to a pause state. The connection selection mechanism can also quickly return the valve body in the pause state to any given lift amount. Specifically, the connection selection mechanism can smoothly effect pause and return operations of the valve body regardless of whether the lift amount is large or small. There is therefore no need to go through unnecessary lift amounts as in the known art when bringing the valve body to a pause or returning the valve body therefrom. This permits smooth control of the lift amount and improves control response.

In accordance with the second aspect of the present invention, the input member and the output member can be integrally or individually rocked about the control shaft. By using the control shaft as a pivot, therefore, the rocking mechanism capable of being connected and disconnected can be compactly disposed on the outer peripheral side of the control shaft. The foregoing arrangement eliminates the need for complicated link parts or the like for selecting power drive transmission between the drive cam and the valve actuating mechanism. This helps simplify the structure, and promote reduction in size, of the entire system. Further, the aspect of the present invention may be applicable to the variable valve apparatus incorporating the known rocking cam arm by simply changing the rocking cam arm to the split type. The aspect of the present invention can therefore be applied easily by making only small-scale changes.

In accordance with the third aspect of the present invention, the split-type rocking mechanism can be formed symmetrically about the specific plane perpendicular to the control shaft. A transmission path, along which a force on the side of the variable mechanism is transmitted to the valve actuating mechanism via the split-type rocking mechanism, may be disposed on the plane. Specifically, various parts of the split-type rocking mechanism can be disposed symmetrically about this transmission path. As a result, when the input of the drive cam is applied to the split-type rocking mechanism, the foregoing arrangement prevents, for example, any torsional force or moment from acting on the split-type rocking mechanism. Accordingly, play in parts constituting the split-type rocking mechanism or reduction in durability of those parts can be suppressed, thus enhancing rigidity. Force by the split-type rocking mechanism can therefore be stably and efficiently transmitted.

In accordance with the fourth aspect of the present invention, the input side abutment portion receiving the force from the side of the variable mechanism and the output side abutment portion outputting the force to the valve actuating mechanism can be disposed linearly in a condition of not being inclined (deviated) relative to the control shaft. Then, the outer support portions and the inner support portions can respectively be disposed symmetrically about above portions. This helps prevent, for example, any torsional force or moment from acting on the split-type rocking mechanism and the force by the split-type rocking mechanism can be stably and efficiently transmitted.

In accordance with the fifth aspect of the present invention, when a valve mechanism having the valve body, the split-type rocking mechanism, the connection selection mechanism, and the valve actuating mechanism is disposed on each of the first and second sides, the variable mechanism can be disposed between the valve mechanism on the first side and the valve mechanism on the second side. In this condition, the variable mechanism can transmit, while receiving the input of the drive cam with the center cam roller, the input to the split-type rocking mechanism on the first side and the split-type rocking mechanism on the second side, respectively, using the intermediate rollers on both sides. This allows the variable mechanism to perform power drive transmission from the drive cam to the split-type rocking mechanisms on both sides in a well-balanced manner through the symmetrical path. Not being subject to torsional force or moment as a whole, the variable mechanism can therefore perform power transmission in a stable manner. In addition, the lift amount of the two valve mechanisms can be varied using the single variable mechanism, which helps build the variable valve apparatus having the plurality of valve bodies compactly.

In accordance with the sixth aspect of the present invention, the non-split-type rocking mechanism can be formed as an integral rocking mechanism having no input or output members, or the like. The valve mechanism having the split-type rocking mechanism can be disposed on the first side of the control shaft, while the valve mechanism having the non-split-type rocking mechanism can be disposed on the second side of the control shaft. The variable mechanism can be disposed between these valve mechanisms. Substantially in the same manner as in the fifth aspect of the present invention, therefore, power drive transmission from the drive cam to the valve mechanisms on both sides can be performed in a well-balanced manner.

The non-split-type rocking mechanism on the second side can transmit the input of the drive cam to the valve actuating mechanism on the second side at all times. Accordingly, if the connected state of the split-type rocking mechanism on the first side is canceled by the connection selection mechanism, the valve body on the second side can perform ordinary open/close operations with the valve body on the first side set in a closed pause state. If the variable valve apparatus is applied to an intake valve of an internal combustion engine, only an intake port on a first side of two intake ports disposed in a combustion chamber of the internal combustion engine can be held in a closed position by the intake valve. At an intake port on a second side, air can be drawn into the combustion chamber as the intake valve opens and closes. Consequently, swirl control or the like that generates a swirl flow of an intake air in the combustion chamber can be easily performed.

In accordance with the seventh aspect of the present invention, when the variable valve apparatus is stationary (that is, is not being driven), the connection selection mechanism can retain the connected state between the input member and the output member. A setting can therefore be made to let the valve body perform the ordinary open/close operations in an initial condition such as when the mechanism is started. Accordingly, the variable valve apparatus or an apparatus mounted with the same can start operating in an ordinary condition at any time.

In accordance with the eighth aspect of the present invention, the input member and the output member can be retained in the connected state when the internal combustion engine is stationary, in which no hydraulic pressure is supplied to the connection selection mechanism. When the internal combustion engine is started, therefore, the valve body can be opened or closed in the ordinary condition at all times, ensuring smooth operation control upon starting.

In accordance with the ninth aspect of the present invention, when supply of the hydraulic pressure to the disengagement means is suspended, the movable pin can be engaged with the engagement hole by the retention means. Accordingly, the input member and the output member can be connected together and the valve body can be opened or closed. When the hydraulic pressure is supplied to the disengagement means, the movable pin can be disengaged from the engagement hole. Accordingly, the input member and the output member can be disconnected from each other and the valve body can be brought to a pause state. A connection selection mechanism of a simple structure of engaging and disengaging the movable pin with/from the engagement hole can therefore be achieved and the connection selection mechanism can be disposed compactly in the split-type rocking mechanism.

In accordance with the tenth aspect of the present invention, when the movable pin of the connection selection mechanism is disengaged from the engagement hole, the input member can make a rocking motion relative to the output member. In this case, the input member makes a rocking motion relative to the output member for every revolution of the drive cam and the engagement hole and the movable pin can be made to oppose each other at least at one location within the rocking range. When the valve body is to be returned from the pause state, therefore, the movable pin can be engaged with the engagement hole within such a short period of time that the drive cam makes about one revolution after the selection operation is performed for return.

In accordance with the eleventh aspect of the present invention, the hydraulically-operated connection selection mechanism can be disposed compactly between the input member and the output member of the split-type rocking mechanism. The hydraulic pressure can be supplied to the connection selection mechanism through the first oil path disposed in the control shaft and the second oil path disposed in the input member or the output member. This eliminates the need, for example, for disposing the connection selection mechanism in the variable mechanism having a relatively complicated structure, or disposing the oil path in the variable mechanism. Accordingly, a space for disposing the connection selection mechanism and the oil path can be easily found, helping simplify the structure of the variable valve apparatus.

In accordance with the twelfth aspect of the present invention, the input side urge means can urge the input member of the split-type rocking mechanism toward the variable mechanism. This allows the input member and the variable mechanism to be pressed toward the side of the drive cam, making these members follow the profile of the drive cam to operate smoothly. Further, the output side urge means can urge the output member toward the valve actuating mechanism. Then, any play or the like can be prevented from occurring in the output member that is placed in a free state when connection between the input member and the output member is canceled.

BEST MODE FOR CARRYING OUT THE INVENTION

First Embodiment

Arrangement of the Variable Valve Apparatus According to the First Embodiment A variable valve apparatus according to a first embodiment of the present invention will be described below with reference to FIGS. 1 through 10.

Figure 1:
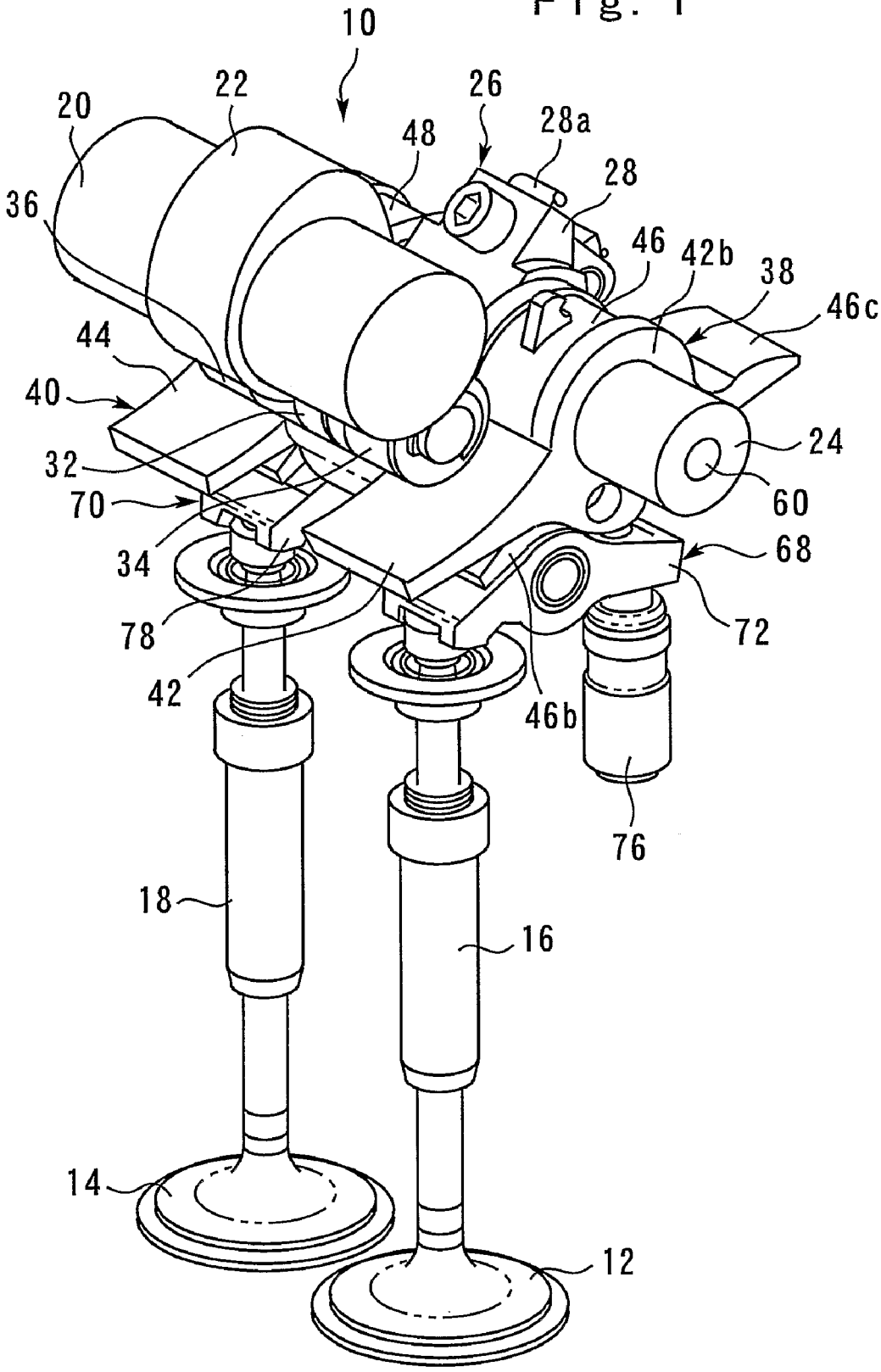
FIG. 1 is a perspective view showing a general arrangement of a variable valve apparatus according to the first embodiment of the present invention.
Figure 2:
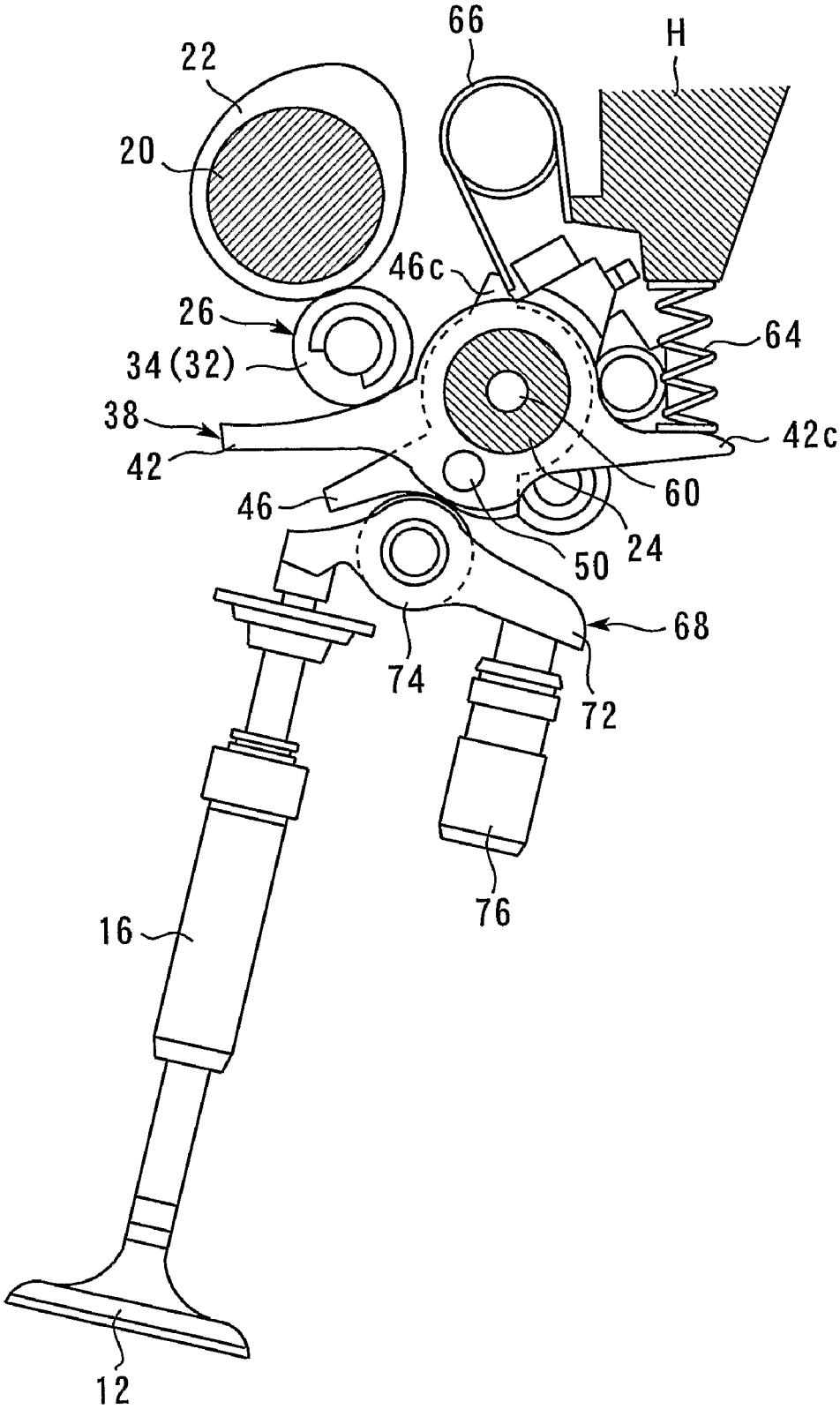
FIG. 2 is a cross-sectional view showing a condition, in which the variable valve apparatus is assembled in an internal combustion engine.

FIG. 1 is a perspective view showing a general arrangement of a variable valve apparatus 10 according to the first embodiment of the present invention. FIG. 2 is a cross-sectional view showing a condition, in which the variable valve apparatus 10 is assembled in a cylinder head H (only part thereof is shown) of an internal combustion engine. For the first embodiment of the present invention, the internal combustion engine mounted with the variable valve apparatus 10 will be described as a four-valve type internal combustion engine having two each intake valves and exhaust valves for each cylinder. Further, the first embodiment of the present invention exemplifies the variable valve apparatus 10 as applied to two intake valves 12, 14 disposed in a single cylinder. In FIG. 1, reference numerals shown in parentheses denote those elements that are hidden behind other visible elements.

Referring to FIGS. 1 and 2, the intake valves 12, 14 open or close two corresponding intake ports (not shown) disposed in a single cylinder of the internal combustion engine. It is to be noted herein that the cylinder head H has valve springs (not shown) urging the intake valves 12, 14 toward a valve closing direction (upward in FIGS. 1 and 2) at all times.

When the internal combustion engine is operated, a driving force (an input) of a drive cam 22 to be described later is transmitted to the intake valves 12, 14 via a variable mechanism 26, split-type rocking cam arms 38, 40, and valve actuating mechanisms 68, 70. The intake valves 12, 14 are thereby opened or closed. In FIG. 1, the intake valve 12, the split-type rocking cam arm 38, and the valve actuating mechanism 68, which are disposed on the right-hand side constitute a first set of valve mechanism. Further, the intake valve 14, the split-type rocking cam arm 40, and the valve actuating mechanism 70, which are disposed on the left-hand side of the FIG. 1, constitute a second set of valve mechanism. These two sets of valve mechanisms are disposed apart from each other axially along a control shaft 24 to be described later, one being disposed on a first side and the other being disposed on a second side. The variable mechanism 26 is disposed between the valve mechanism on the first side and the valve mechanism on the second side.

A power drive transmission flow of the first embodiment of the present invention will be described below. The cylinder head H of the internal combustion engine includes a camshaft 20. The camshaft 20 is directly connected to an output shaft of the internal combustion engine, rotatably driven in time with an engine speed. The drive cam 22 is fixed on an outer periphery of the camshaft 20. The drive cam 22 has a profile setting open/close timing of the intake valves 12, 14.

The control shaft 24 is rotatably mounted in the cylinder head H at a position near the camshaft 20. The control shaft 24 is rotatably driven by a lift amount control actuator (not shown), controlling the lift amount of the intake valves 12, 14 according to the rotating angle thereof. The control shaft 24 is mounted with the variable mechanism 26 that is displaceable relative to the drive cam 22.

(Arrangement of the Variable Mechanism)

The variable mechanism 26 will be described below with reference to FIG. 3. The variable mechanism 26 includes a fixing portion 28, an arm portion 30, a cam roller 32, and intermediate rollers 34, 36. The fixing portion 28 is formed annularly and fitted by insertion to an outer peripheral side of the control shaft 24 between the split-type rocking cam arms 38, 40. The fixing portion 28 includes a lock pin **28*a* which, in turn, is fitted by insertion into amounting hole 24*a* made in an outer peripheral surface of the control shaft 24. This results in the fixing portion 28 being fixed to the outer peripheral side of the control shaft 24** with relative rotation thereof being restricted.

The arm portion 30 is curved into a substantially C shape. The arm portion 30 has a proximal end thereof rotatably connected to the fixing portion 28. The arm portion 30 has a distal end thereof protruding in a diametrical direction of the control shaft 24. The three rollers 32, 34, 36 are rotatably mounted coaxially side by side on the protruding distal end.

In this case, the cam roller 32 disposed at an axial center abuts against the drive cam 22. The state of the abutment is retained by a spring force of a lost motion spring 64 (see FIG. 2) to be described later. Accordingly, when the drive cam 22 rotates, the cam roller 32 follows a profile of the drive cam 22 to make a reciprocating motion.

The intermediate rollers 34, 36 are disposed on both sides axially of the cam roller 32. The intermediate roller 34 on a first side abuts against an input arm 42 of the split-type rocking cam arm 38. The intermediate roller 36 on a second side abuts against an input, arm 44 of the split-type rocking cam arm 40. The state of the abutment between the intermediate rollers 34, 36 and the input arms 42, 44 is retained by the spring force of the lost motion spring 64. The intermediate rollers 34, 36 make a reciprocating motion with the cam roller 32 that receives the input of the drive cam 22, so that the reciprocating motion is transmitted to the input arms 42, 44, respectively.

When the control shaft 24 is rotated, the arm portion 30 is pulled or moved so as to apply pressure according to a rotating angle of the control shaft 24. As a result, each of the rollers 32, 34, 36 is displaced close to, or away from, the control shaft 24 (in a substantially diametrical direction of the control shaft 24) and retained in a position corresponding to the rotating angle of the control shaft 24. As a result, the split-type rocking cam arms 38, 40 make a rocking motion with amplitude corresponding to the position of the intermediate rollers 34, 36, so that a lift amount of the intake valves 12, 14 is variable corresponding to the amplitude.

(Arrangement of the Split-Type Rocking Cam Arm)

The split-type rocking cam arms 38, 40 (hereinafter referred to simply as rocking cam arms 38, 40) will be described below. The rocking cam arms 38, 40 are disposed on first and second axial ends of the variable mechanism 26, respectively. The rocking cam arms 38, 40 are rockably mounted on the outer peripheral side of the control shaft 24. In addition, the rocking cam arms 38, 40 include the input arms 42, 44 and output arms 46, 48, respectively.

Figure 4:
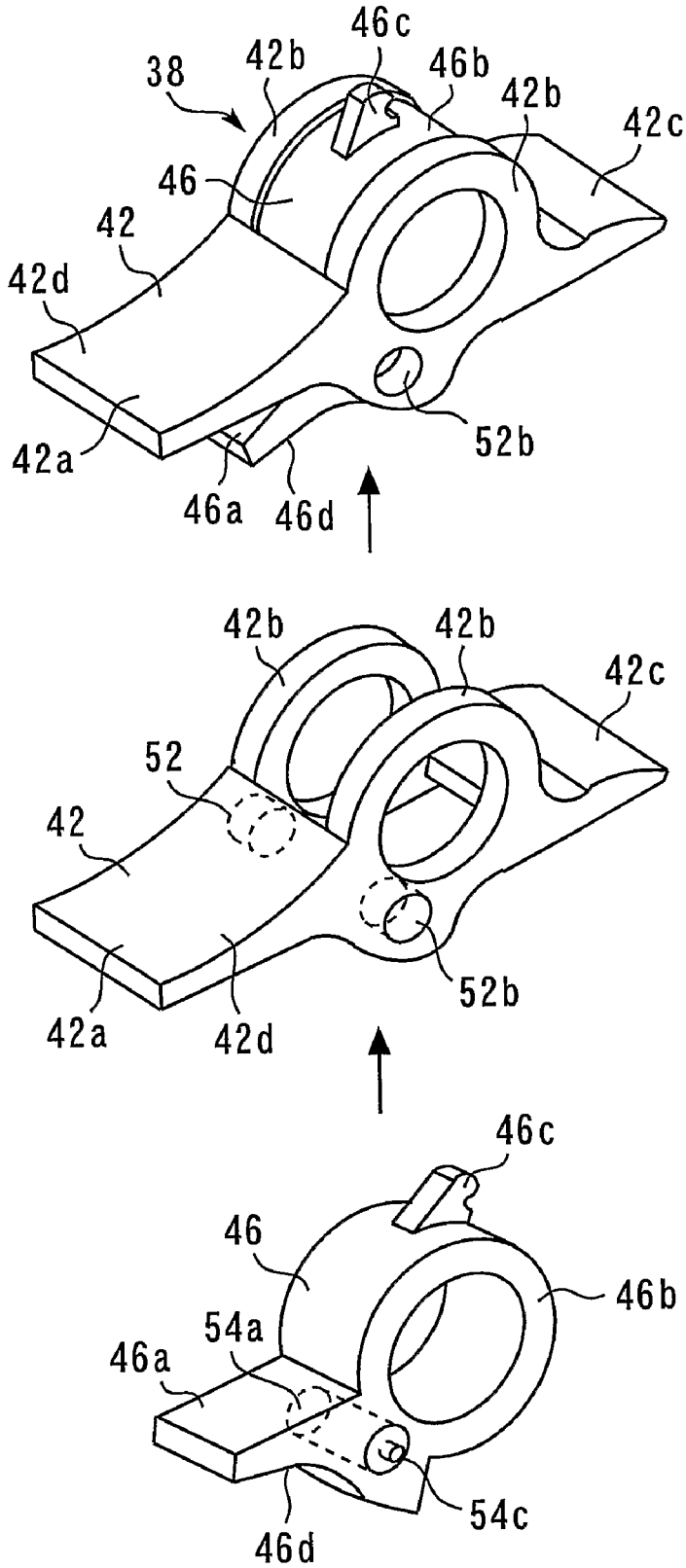
FIG. 4 is a perspective view showing a condition, in which the split-type rocking cam arms are assembled/re-assembled together.
Figure 5:
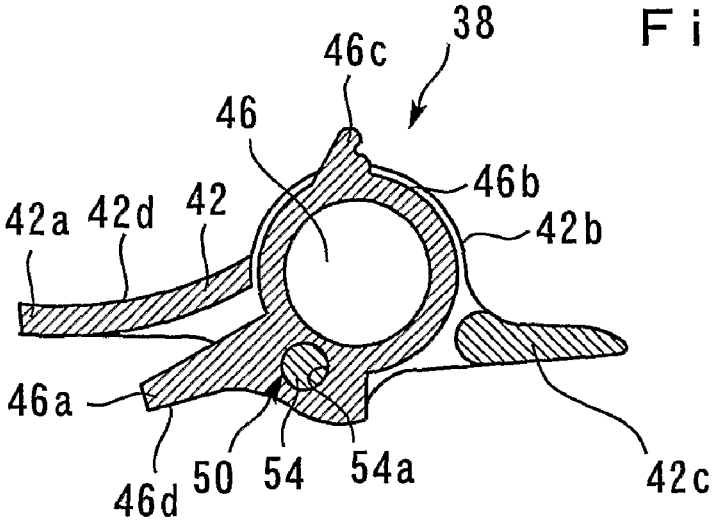
FIG. 5 is a transverse section view showing a condition, in which the split-type rocking cam arms break off along the plane perpendicular to the control shaft.
Figure 6:
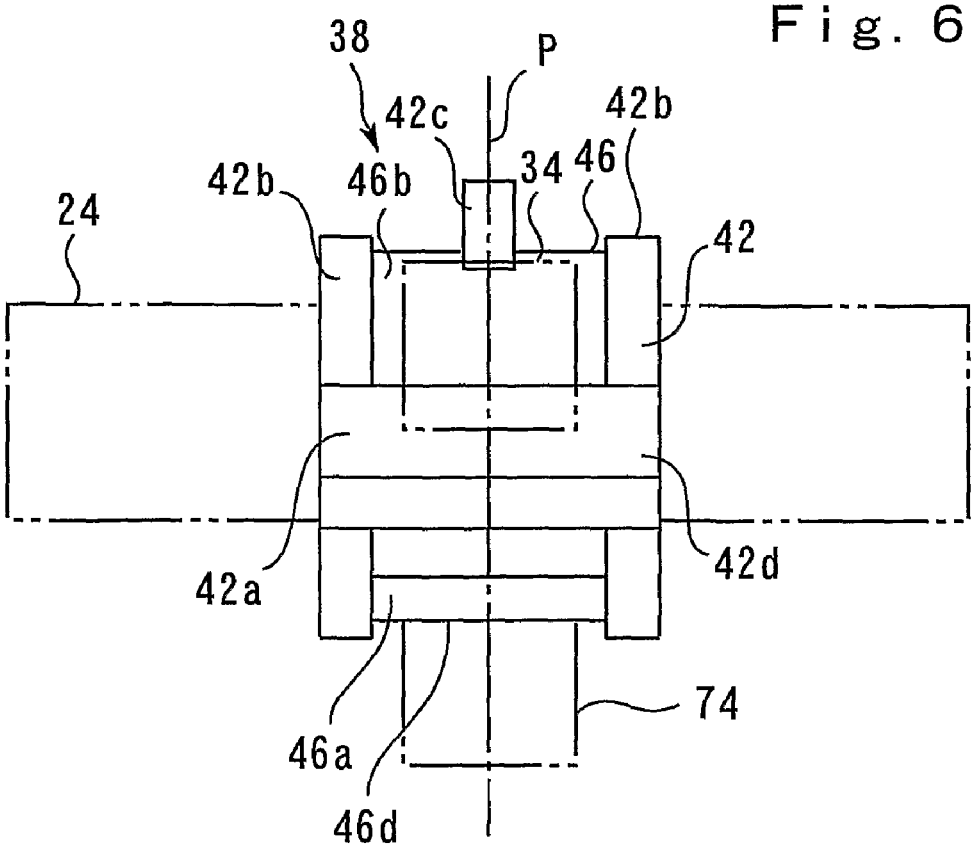
FIG. 6 is a view where the split-type rocking cam arms is seen from the left side in FIG. 5.

FIGS. 4 to 6 are views showing the input arm 42 and the output arm 46 constituting the split-type rocking cam arm 38 on the first side. The input arm 42 includes a plate-like intermediate roller abutment portion 42*a*, two outer support portions 42*b*, 42*b*, and a spring retainer portion 42*c*. The two outer support portions 42*b*, 42*b* are substantially annularly shaped. The intermediate roller abutment portion 42*a* has a proximal end thereof fixed to each of the outer support portions 42*b*, 42*b* and a distal end thereof protruding diametrically from the outer support portions 42*b*, 42*b*. The intermediate roller abutment portion 42*a* has a front surface, on which a roller surface 42*d* receiving the input from the intermediate roller 34 on the first side is formed.

The two outer support portions 42*b*, 42*b* are disposed on both sides of the intermediate roller abutment portion 42*a*, being axially spaced apart from each other. The outer support portions 42*b*, 42*b* are slidably fitted by insertion on the outer peripheral side of, and rockably supported by, the control shaft 24. The intermediate roller abutment portion 42*a* and the spring retainer portion 42*c* are fixed between the two outer support portions 42*b*, 42*b*. The spring retainer portion 42*c* is disposed on a side diametrically opposite the intermediate roller abutment portion 42*a* across the outer support portions 42*b*, 42*b*. The spring retainer portion 42*c* protrudes diametrically from the outer support portions 42*b*, 42*b*. The spring retainer portion 42*c* receives the spring force of the lost motion spring 64 (see FIG. 2) to be described later.

The output arm 46 includes a plate-like rocker roller abutment portion 46*a*, a tubular inner support portion 46*b*, and a spring retainer portion 46*c*. The rocker roller abutment portion 46*a* protrudes diametrically from the inner support portion 46*b*. The rocker roller abutment portion 46*a* has a front surface, on which a cam surface 46*d* outputting rocking motion to a rocker roller 74 to be described later is formed. The inner support portion 46*b* is slidably fitted by insertion on the outer peripheral side of, and rockably supported by, the control shaft 24. Further, the spring retainer portion 46*c* protrudes diametrically from the inner support portion 46*b* to receive the spring force of an auxiliary spring 66 (see FIG. 2) to be described later.

Referring to FIGS. 5 and 6, in a condition, in which the input arm 42 and the output arm 46 are assembled together, the inner support portion 46*b* of the output arm 46 is disposed between the outer support portions 42*b* of the input arm 42. In this condition, the intermediate roller abutment portion 42*a* and the rocker roller abutment portion 46*a* overlap each other at the same axial position.

Specifically, the abutment portions 42*a*, 46*a* and the support portions 42*b*, 46*b* are formed substantially symmetrically on both axial sides about a plane P shown in FIG. 6. The plane P passes through an axial middle position of the intermediate roller 34 and the rocker roller 74 and is perpendicular to the control shaft 24. To state it another way, the intermediate roller 34 receiving the input from the drive cam 22, the abutment portions 42*a*, 46*a*, and the rocker roller 74 are disposed linearly not being inclined (deviated) relative to the control shaft 24, while the support portions 42*b*, 46*b* support the abutment portions 42*a*, 46*a* at positions symmetrical about the above-referenced members on both sides thereof.

A connection selection mechanism 50 to be described later is disposed between the input arm 42 and the output arm 46. The input arm 42 and the output arm 46, when connected with each other by the connection selection mechanism 50, make a rocking motion integrally about the control shaft 24. When the connected state between the arms 42 and 46 is canceled, the input arm 42 and the output arm 46 become individually rockable. As a result, the rocking motion of the input arm 42 is no longer transmitted to the output arm 46, bringing the intake valve 12 to a pause state.

(Arrangement of the Split-Type Rocking Cam Arm on the Second Side)

Figure 3:
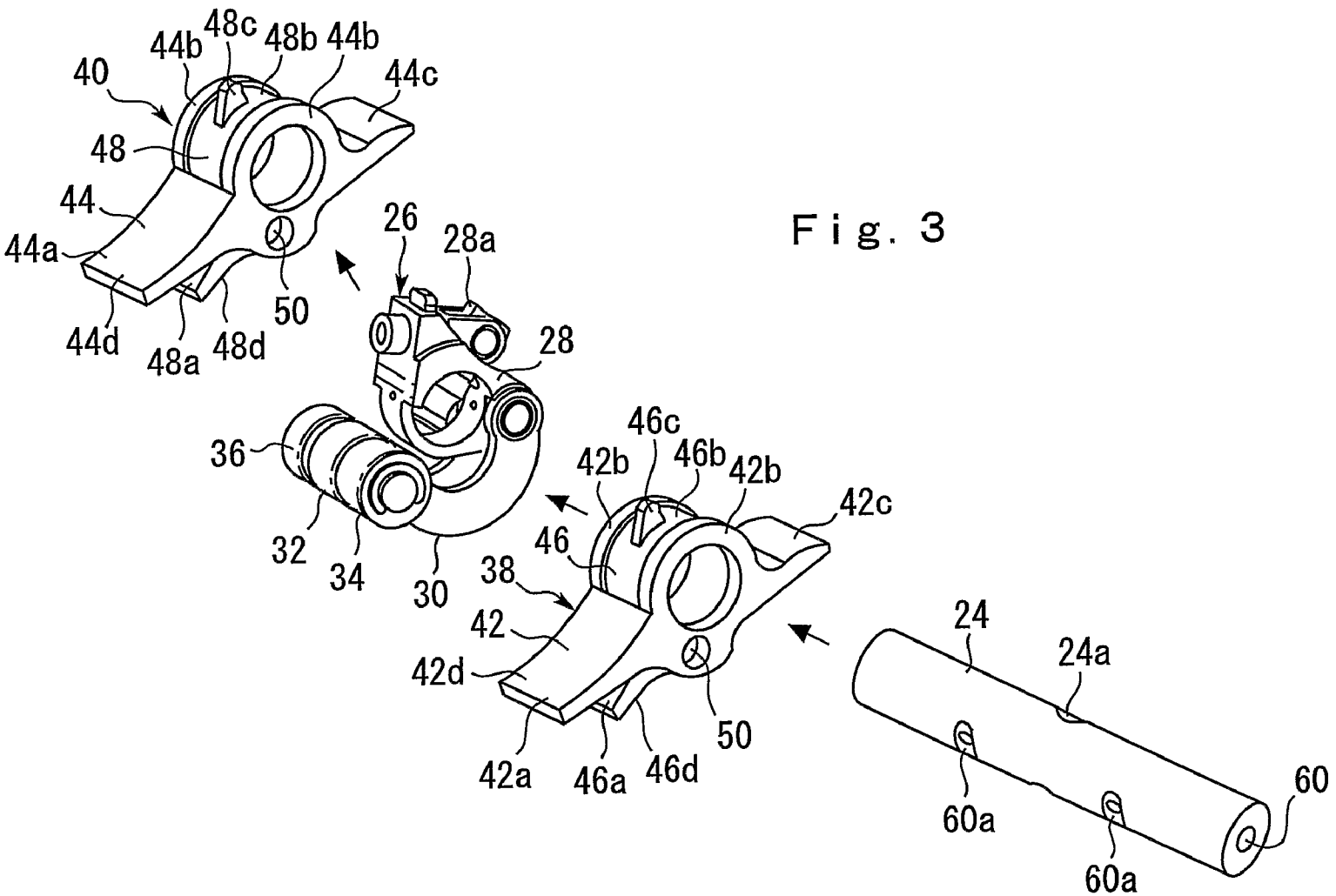
FIG. 3 is an exploded perspective view showing the control shaft of the variable valve apparatus, variable mechanism and the split-type rocking cam arms.

Referring to FIGS. 1 and 3, the input arm 44 and the output arm 48, which constitute the rocking cam arm 40 on the second side, have substantially the same arrangement as the rocking cam arm 38 on the first side. Specifically, the input arm 44 includes an intermediate roller abutment portion 44*a*, an outer support portion 44*b*, a spring retainer portion 44*c*, and a roller surface 44*d*. The output arm 48 includes a rocker roller abutment portion 48*a*, an inner support portion 48*b*, a spring retainer portion 48*c*, and a cam surface 48*d*. The rocking cam arm 40 also includes the connection selection mechanism 50, the auxiliary spring 66, and the lost motion spring 64. These elements are not shown.

(Arrangement of the Connection Selection Mechanism)

Figure 7:
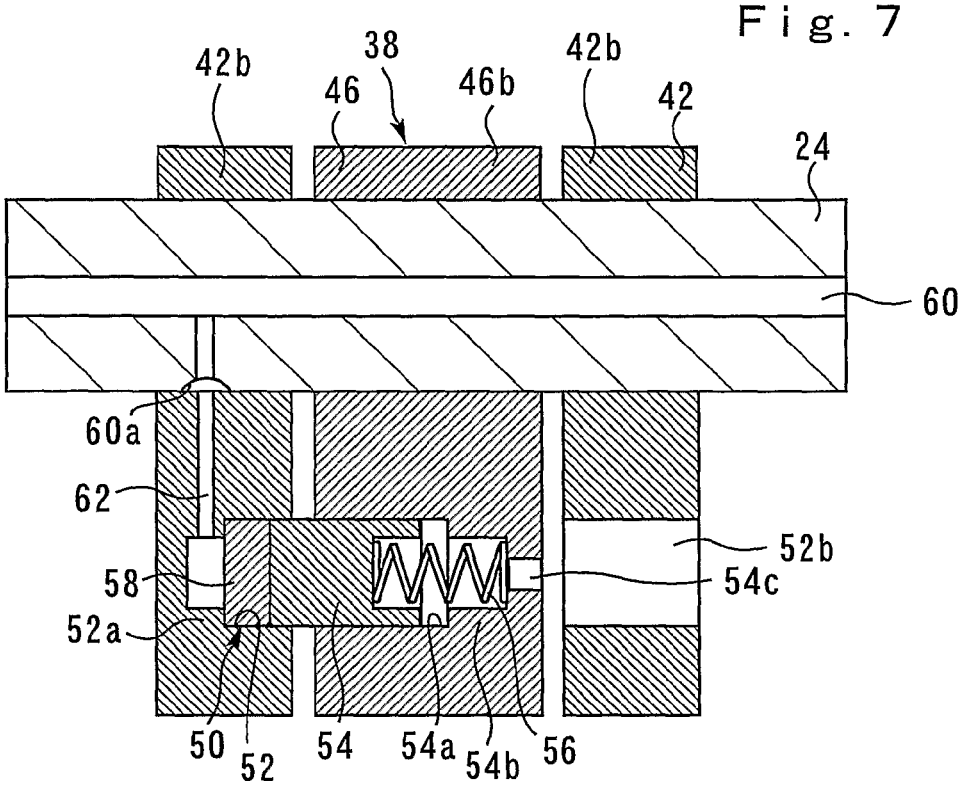
FIG. 7 is a longitudinal-sectional view showing the control shaft, the split-type rocking cam arms and the connection selection mechanism break with a plane along the axis of the control shaft.
Figure 8:
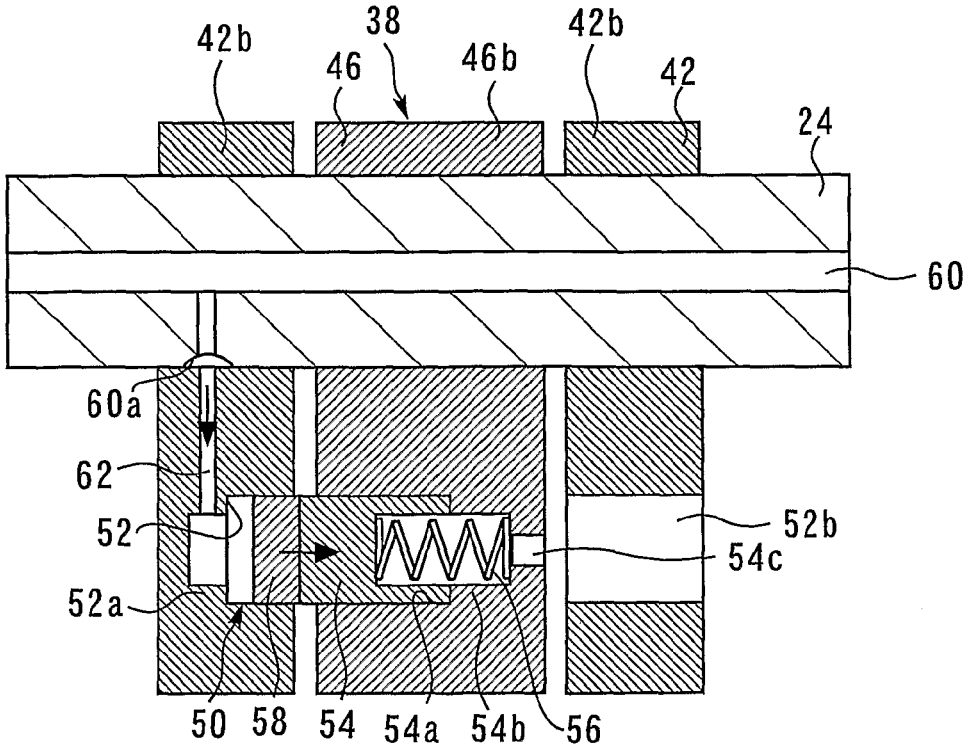
FIG. 8 is a longitudinal-sectional view showing a condition, in which the connection between the input arm and the output arm shown in FIG. 7 is canceled.

Referring to FIGS. 7 and 8, the connection selection mechanism 50 of a hydraulically operated type disposed in the rocking cam arms 38, 40 will be described below. The connection selection mechanism 50 on the side of the rocking cam arm 38 will be described as an example.

The connection selection mechanism 50 includes an engagement hole 52, a movable pin 54, a retention spring 56, a piston 58, and oil paths 60, 62. In accordance with the first embodiment of the present invention, the input arm 42 of the two arms 42, 46 constituting the rocking cam arm 38 includes the engagement hole 52, while the output arm 46 includes the movable pin 54.

A first one of the two outer support portions 42*b*, 42*b* constituting the input arm 42 includes the engagement hole 52 formed as a blind hole opening to an inner end face thereof. Further, a shoulder portion 52*a* for setting the maximum advance position of the movable pin 54 is formed in a protruding condition diametrically inwardly on a bottom side of the engagement hole 52. A second one of the two outer support portions 42*b*, 42*b* includes a machined hole 52*b* used for drilling the engagement hole 52.

The movable pin 54 is slidably fitted by insertion in a pin hole 54*a* formed in the inner support portion 46*b* of the output arm 46. In this case, the pin hole 54*a* is formed as a blind hole opening to an end face of the inner support portion 46*b*. A shoulder portion 54*b* for setting the maximum advance position of the movable pin 54 and a vent hole 54*c* permitting entry and exit of air in and out of the pin hole 54*a* are formed on a bottom side of the pin hole 54*a*.

Referring to FIGS. 7 and 8, the movable pin 54 engages with or disengages from the engagement hole 52 according to a hydraulic pressure supplied to the engagement hole 52, so that the input arm 42 is connected with or disconnected from the output arm 46.

The retention spring 56 is disposed in a compressed state between the movable pin 54 and the bottom side of the pin hole 54*a*. The retention spring 56 urges the movable pin 54 at all times toward the engagement hole 52. This results in the movable pin 54 being retained in an engaged state in the engagement hole 52 when the hydraulic pressure does not act on the piston 58. The piston 58, on the other hand, is slidably fitted in an open side of the engagement hole 52.

The piston 58 moves the movable pin 54 so as to apply pressure thereto against a spring force of the retention spring 56 when the hydraulic pressure is supplied into the engagement hole 52 from the oil path 60 to be described later, so that the movable pin 54 is disengaged from the engagement hole 52. As such, the connection selection mechanism 50 keeps the input arm 42 and the output arm 46 in a connected state at all times (when no hydraulic pressure is supplied into the engagement hole 52). When the hydraulic pressure generated when the internal combustion engine operates is supplied, the connection selection mechanism 50 is driven by the hydraulic pressure, disconnecting the above-referenced connection.

The two oil paths 60, 62 provided as an adjunct for the connection selection mechanism 50 will be described below. A first oil path 60 is connected to a hydraulic control circuit (not shown) or the like serving as a hydraulic pressure source for cylinder pause control. The first oil path 60 is drilled axially in the control shaft 24. Part of the oil path 60 branches diametrically at a position corresponding to the outer support portion 42*b* of the input arm 42 and is opened in an outer peripheral surface of the control shaft 24. The opening includes a slot 60*a* (see FIG. 3) extending in a circumferential direction to have a length corresponding to a rotation range of the control shaft 24.

A second oil path 62 is drilled diametrically in the outer support portion 42*b* of the input arm 42 at a position opposing the slot 60*a*. Accordingly, the two oil paths 60, 62 are held in a connected state through the slot 60*a* even when the control shaft 24 rotates. The oil path 62 is open to the engagement hole 52. Further, the oil path 60 is also connected to the connection selection mechanism 50 of the rocking cam arm 40 on the second side through an oil path 62 on the second side (not shown) formed in the same manner as the oil path 62 on the first side. Accordingly, when a hydraulic pressure is outputted from the hydraulic control circuit, the hydraulic pressure is supplied to the engagement hole 52 of the connection selection mechanism 50 on each of the first and second sides through the oil paths 60, 62. An operating state of these connection selection mechanisms 50 is together selected.

The first embodiment of the present invention is thus arranged such that, when the hydraulic pressure is outputted to the oil path 60 from the hydraulic control circuit, the hydraulic pressure is supplied to the valve mechanisms on the first and second sides through the two oil paths 62, thereby bringing both intake valves 12, 14 to a pause at the same time. The present invention is not limited to the foregoing arrangement; rather, for example, only either one of the intake valves 12, 14 may be adapted to be brought to a pause state. In this arrangement, the oil path 60 according to the first embodiment of the present invention is, for example, is split in a midway point, so that an oil path 60 connected to an oil path 62 on the first side and an oil path 60 connected to an oil path 62 on the second side are formed independently of each other. The hydraulic pressure is then supplied to each of the two oil paths 60 independently of each other.

(Arrangement of the Spring)

Figure 9:
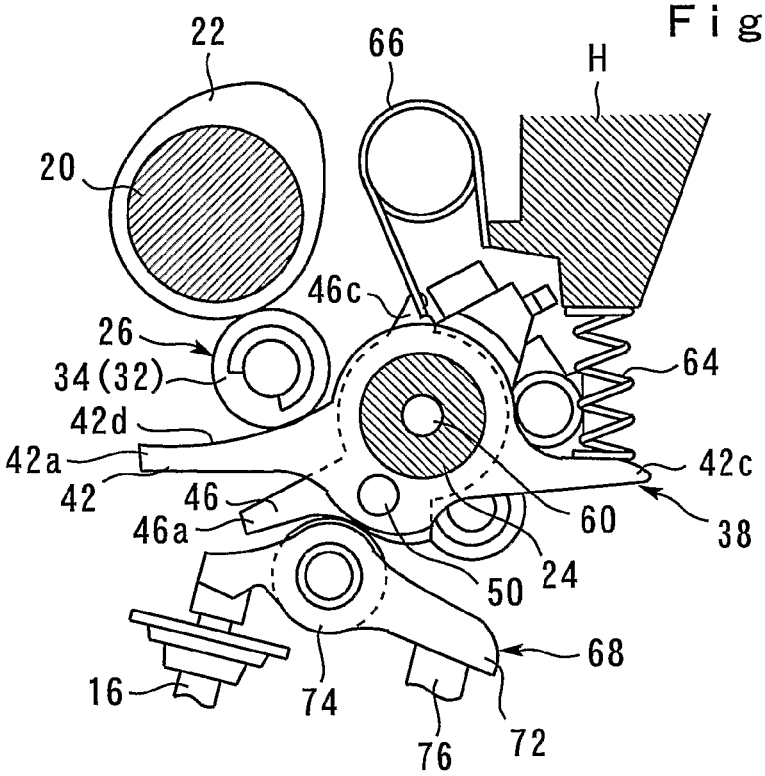
FIG. 9 is an essential part enlarged view of FIG. 2, showing the around split-type rocking cam arms.
Figure 10:
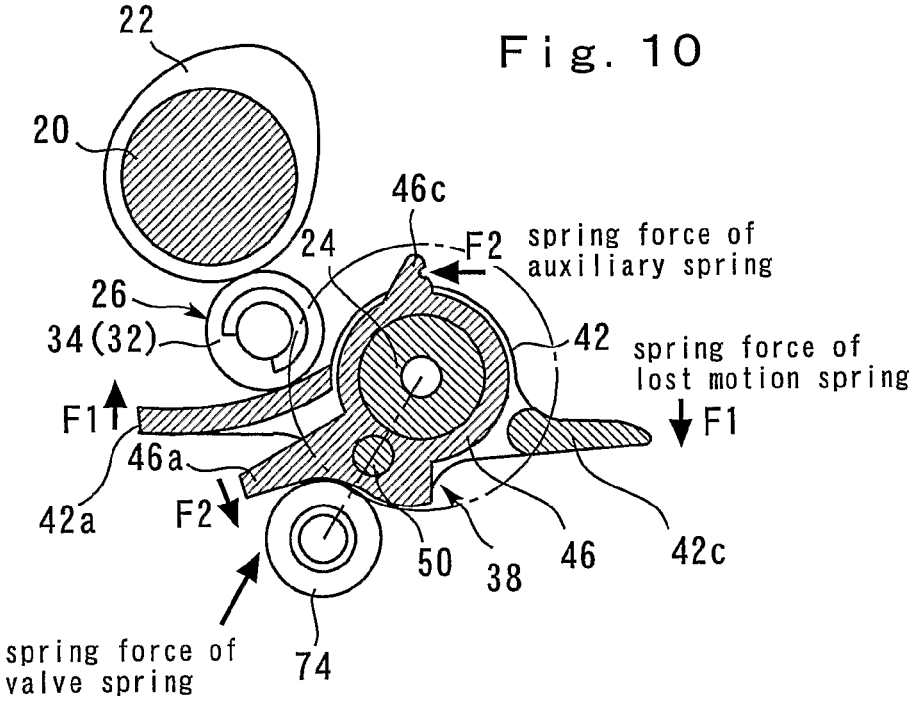
FIG. 10 is a view showing the function of a lost motion spring and an auxiliary spring in FIG. 9.

The lost motion spring 64 and the auxiliary spring 66 provided as adjuncts in the rocking cam arm 38 on the first side will be described with reference to FIGS. 9 and 10. The lost motion spring 64 is disposed between the spring retainer portion 42*c* of the input arm 42 and the cylinder head H in a compressed state. The lost motion spring 64 urges the input arm 42 in a clockwise direction (in a direction of an arrow F1 in FIG. 10) about the control shaft 24. As a result, the lost motion spring 64 presses the intermediate roller abutment portion 42*a* of the input arm 42 up against the intermediate roller 34 and the cam roller 32 up against the drive cam 22 via the intermediate roller 34.

The auxiliary spring 66 is disposed between the spring retainer portion 46*c* of the output arm 46 and the cylinder head H in a compressed state. The auxiliary spring 66 urges the output arm 46 in a counterclockwise direction (in a direction of an arrow F2 in FIG. 10). As a result, the auxiliary spring 66 presses the rocker roller abutment portion 46*a* of the output arm 46 up against the rocker roller 74, thus preventing any play from occurring in the foregoing elements.

(Arrangement of the Valve Actuating Mechanism)

The valve actuating mechanisms 68, 70 that translate the rocking motion of the output arms 46, 48 to a corresponding open/close operation of the intake valves 12, 14 will be described below. Referring to FIG. 1, the valve actuating mechanism 68 on a first side includes a rocker arm 72, the rocker roller 74, and a lash adjuster 76. A valve stem 16 of the intake valve 12 is rockably connected to a first end side of the rocker arm 72. The rocker arm 72 has a second end side rockably supported by the lash adjuster 76. The rocker roller 74 is rotatably disposed at an intermediate portion of the rocker arm 72.

When the output arm 46 moves the rocker roller 74 so as to apply pressure thereto, the rocker arm 72 makes a rocking motion about a leading end portion of the lash adjuster 76. The intake valve 12 is thereby opened or closed. The valve actuating mechanism 70 on a second side also includes, as in the valve actuating mechanism 68 on the first side, a rocker arm 78, and a rocker roller and a lash adjuster (shown only partly). The valve actuating mechanism 70 transmits a rocking motion of the output arm 48 to a valve stem 18 of the intake valve 14, so that the intake valve 14 is opened or closed.

[Operation of the First Embodiment]

Referring to FIGS. 11 through 17, operation of the variable valve apparatus 10 according to the first embodiment of the present invention will be described below. The two valve mechanisms (intake valves 12, 14) perform the same open/close operations. FIGS. 11 through 17 therefore illustrate operations of the valve mechanism on the first side (intake valve 12).

(Open/Close Operation Involving a Large Lift Amount)

Figure 11:
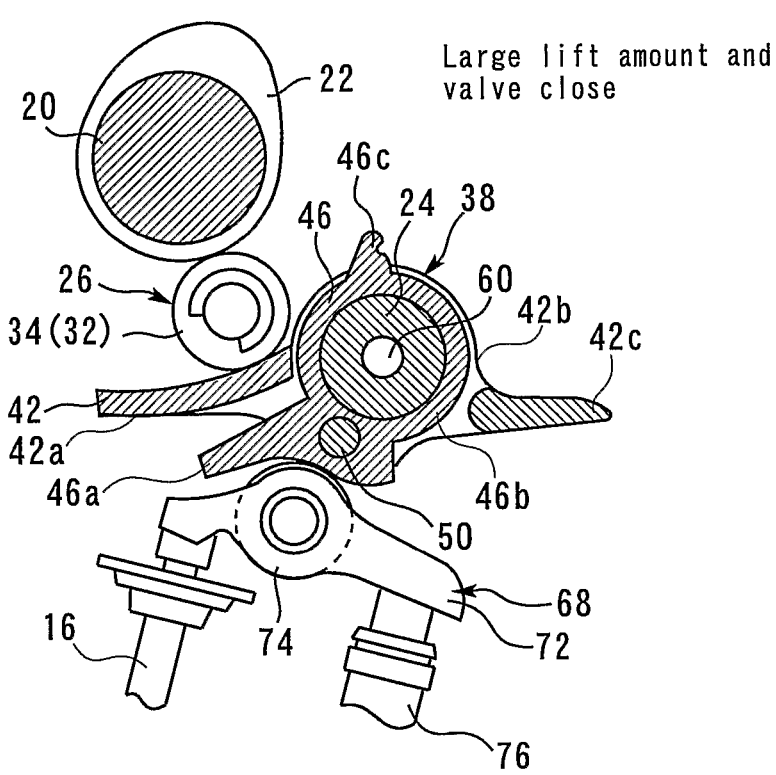
FIG. 11 is a view showing a condition, in which the variable valve apparatus set to have a large lift amount are closed.
Figure 12:
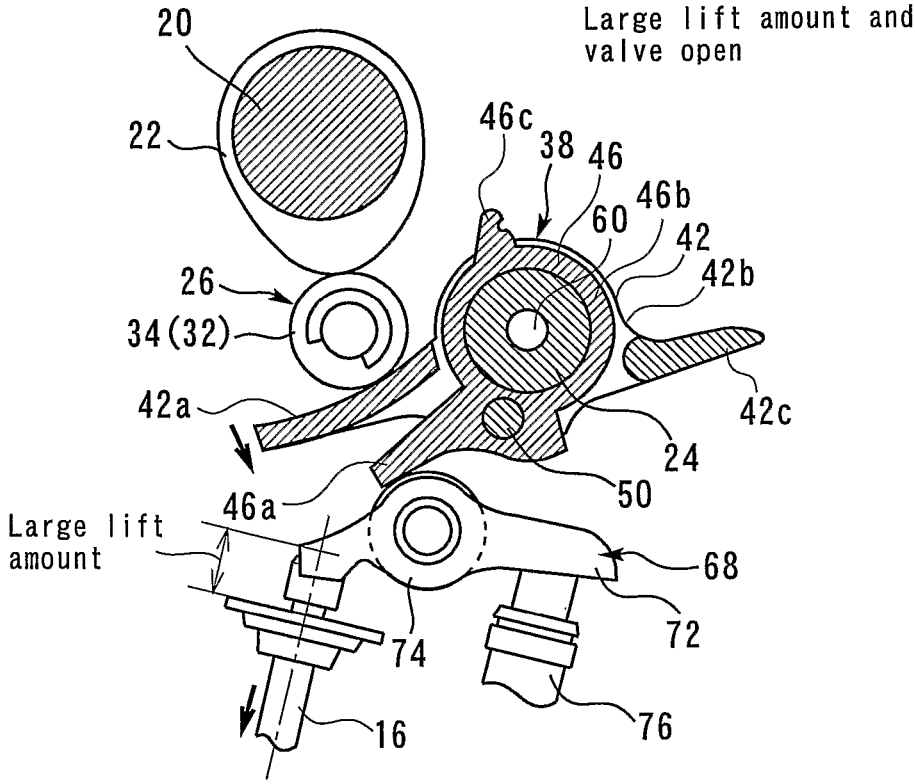
FIG. 12 is a view showing a condition, in which the variable valve apparatus shown in FIG. 11, are open.

FIGS. 11 and 12 are views showing a condition, in which a large lift amount of the intake valves 12, 14 is set. Specifically, FIG. 11 shows a condition, in which the intake valves 12, 14 set to have a large lift amount are closed, while FIG. 12 shows a condition, in which the intake valves 12, 14 are open.

To increase the lift amount, the control shaft 24 is rotated in a predetermined direction (counterclockwise according to the first embodiment of the present invention) by the lift amount control actuator. As a result, the rollers 32, 34, 36 of the variable mechanism 26 are pulled in a direction of approaching the control shaft 24 by way of the arm portion 30, and are retained at a position resulting in a large lift amount. At this position, the intermediate rollers 34, 36 abut against the proximal end sides of the intermediate roller abutment portions 42*a*, 44*a* of the input arms 42, 44.

Supply of hydraulic pressure to the oil path 60 shown in FIG. 7 is suspended in order to open or close the intake valves 12, 14. Accordingly, the movable pin 54 of the connection selection mechanism 50 is retained in the engaged state in the engagement hole 52 by the spring force of the retention spring 56. Accordingly, the input arm 42 and the output arm 46, and the input arm 44 and the output arm 48, are respectively connected together by the connection selection mechanism 50.

If the internal combustion engine operates in this condition, the drive cam 22 is rotatably driven and the cam roller 32 follows the profile of the drive cam 22 to make a reciprocating motion as shown in FIGS. 11 and 12. At this time, the intermediate rollers 34, 36 make a reciprocating motion on the proximal end side of the intermediate roller abutment portions 42*a*, 44*a* with the cam roller 32, thereby rocking the input arms 42, 44 with a large amplitude. The rocking motion is transmitted to the rocker arms 72, 78 by the output arms 46, 48 making a rocking motion with the input arms 42, 44. As a result, the rocker arms 72, 78 make a rocking motion with a large amplitude, causing the intake valves 12, 14 to open/close with a large lift amount.

(Valve Pause Operation Involving a Large Lift Amount)

Figure 13:
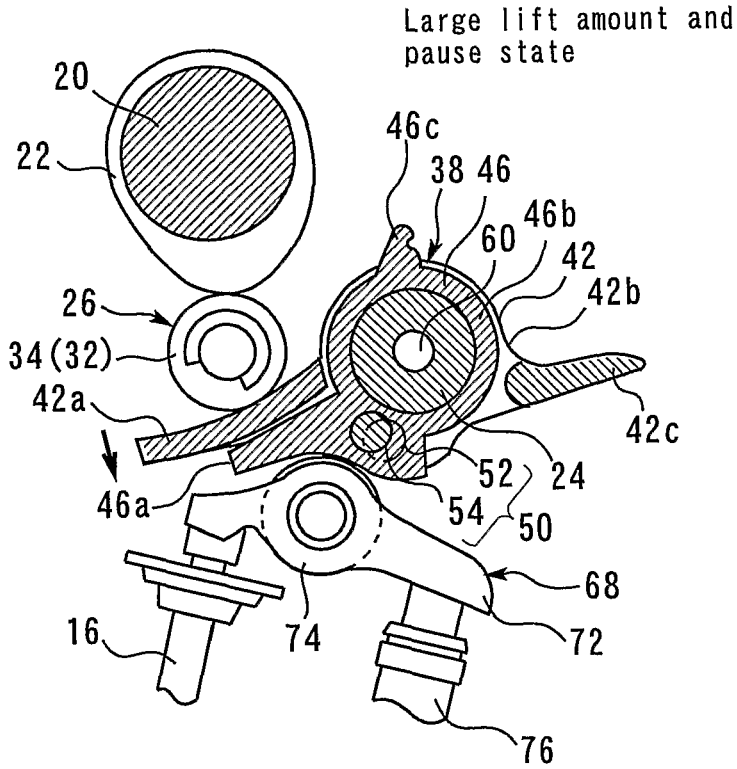
FIG. 13 is a view showing a condition, in which the variable valve apparatus are brought into a pause state.

FIG. 13 is a view showing a condition, in which the intake valves 12, 14 being opened or closed with a large lift amount are brought into a pause state. To let the intake valves 12, 14 pause, a hydraulic pressure is applied to the oil path 60 (see FIG. 7) from the hydraulic control circuit for cylinder pause control. The hydraulic pressure is supplied to the engagement hole 52 of the connection selection mechanism 50 on each of the first and second sides via the oil paths 60, 62, and the like. As a result, in each connection selection mechanism 50, the piston 58 moves the movable pin 54 so as to apply pressure thereto against the spring force of the retention spring 56, so that the movable pin 54 is disengaged from the engagement hole 52. This disconnects the connection between the input arm 42 and the output arm 46, and between the input arm 44 and the output arm 48, respectively.

In this connection disengaged state, referring to FIGS. 11 and 13, the input arms 42, 44 only make a rocking motion even if the reciprocating motion of the intermediate rollers 34, 36 is transmitted to the input arms 42, 44. At this time, the output arms 46, 48 are in a free state on the periphery of the control shaft 24; however, the spring force of the auxiliary spring 66 presses the output arms 46, 48 up against the rocker roller 74, so that the output arms 46, 48 are held in a stationary state. As such, the input arms 42, 44 make a rocking motion relative to the output arms 46, 48, so that the input of the drive cam 22 is absorbed. As a result, the input of the drive cam 22 is not transmitted to the rocker arms 72, 78, thus making the intake valves 12, 14 in a closed pause state.

(Return from the Valve Pause State)

To return the intake valves 12, 14 in a temporary pause state to a normal operating condition, the hydraulic pressure supply to the oil path 60 is suspended in FIG. 7. When the supply of the hydraulic pressure is halted, the movable pin 54 is made to abut against the end face of the input arms 42, 44 (the outer support portions 42*b*, 44*b*) by the spring force of the retention spring 56. As the input arms 42, 44 make a rocking motion to cause the movable pin 54 to be disposed opposing the engagement hole 52, the movable pin 54 is pushed into engagement with the engagement hole 52. As a result, the input arms 42, 44 and the output arms 46, 48, are respectively connected together by the movable pin 54, so as to make a rocking motion integrally. The intake valves 12, 14 then resume the ordinary open/close operations.

(Positional Relationship Between the Engagement Hole 52 and the Movable Pin 54)

Figure 14:
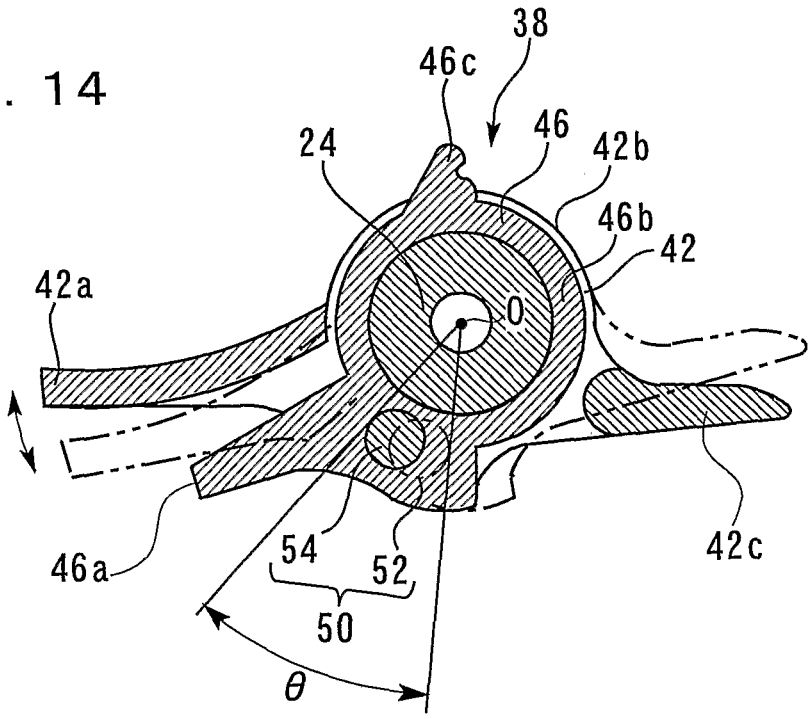
FIG. 14 is a view showing a condition, in which the connection selection mechanism with the valve pause state as in the case of the large lift amount.

In the abovementioned valve pause state, the input arms 42, 44 make a rocking motion within a rocking range θ corresponding to the lift amount setting for each revolution of the drive cam 22 as shown in FIG. 14. The rocking range θ has a reference point at a center O of the control shaft 24. When the input arms 42, 44 make a rocking motion, the engagement hole 52 of the connection selection mechanism 50 also makes a rocking motion within the rocking range θ relative to the movable pin 54. The engagement hole 52 and the movable pin 54 are, however, disposed so as to oppose each other at least one position within the rocking range θ.

Accordingly, when the intake valves 12, 14 are to be returned from the pause state, the engagement hole 52 and the movable pin 54 reaches the mutually opposing position during a period of one revolution of the drive cam 22 at a maximum after the halt of the hydraulic pressure supply to the oil path 60. At this mutually opposing position, the movable pin 54 can be engaged in the engagement hole 52.

(Open/Close Operation Involving a Small Lift Amount)

Figure 15:
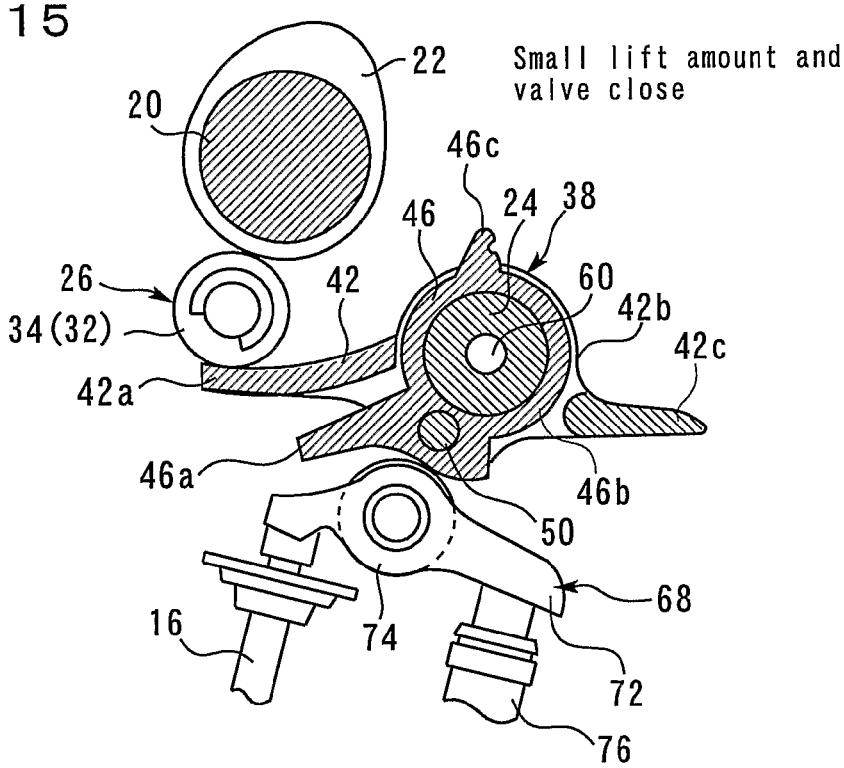
FIG. 15 shows a condition, in which the variable valve apparatus set to have a small lift amount are closed.
Figure 16:
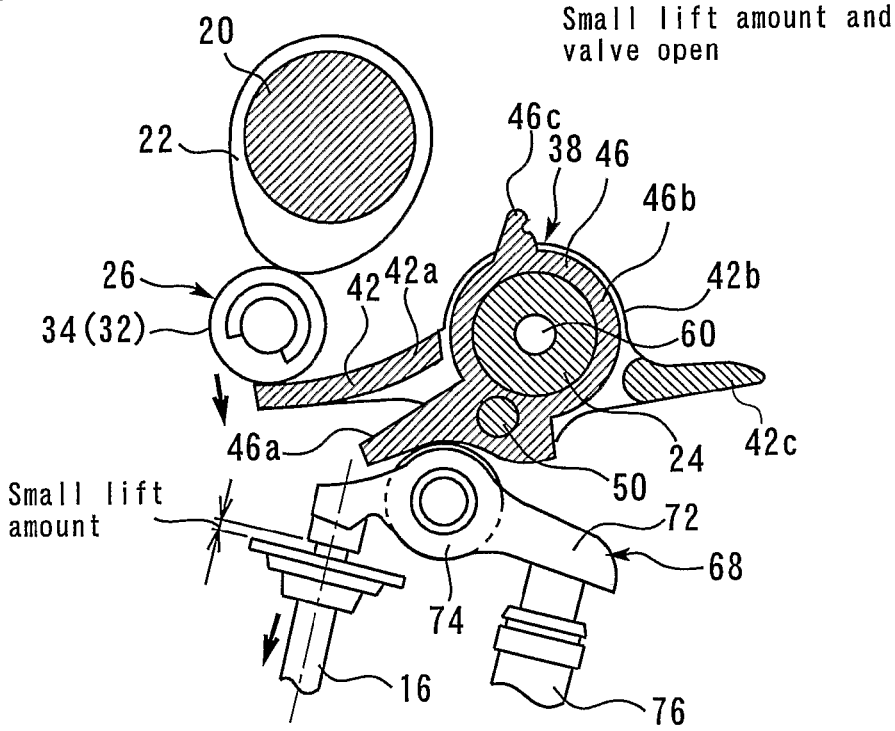
FIG. 16 shows a condition, in which the variable valve apparatus shown in FIG. 15, are opened.

FIGS. 15 and 16 are views showing a condition, in which the lift amount of the intake valves 12, 14 is set small. Specifically, FIG. 15 shows a condition, in which the intake valves 12, 14 set to have a small lift amount are closed, while FIG. 16 shows a condition, in which the intake valves 12, 14 are opened.

To decrease the lift amount, the control shaft 24 is rotated in a direction opposite that for increasing the lift amount (clockwise). As a result, the rollers 32, 34, 36 of the variable mechanism 26 are pushed in a direction of moving away from the control shaft 24 by way of the arm portion 30 and retained at a position resulting in a small lift amount. At this position, the intermediate rollers 34, 36 abut against the distal end sides of the intermediate roller abutment portions 42*a*, 44*a* of the input arms 42, 44. In addition, the input arms 42, 44 and the output arms 46, 48 are in a connected state.

If the input of the drive cam 22 is transmitted to the intermediate rollers 34, 36 in this condition, the intermediate rollers 34, 36 make a reciprocating motion on the distal end side of the intermediate roller abutment portions 42*a*, 44*a*, thus rocking the input arms 42, 44 with a small amplitude. The rocking motion is transmitted to the intake valves 12, 14 via the valve actuating mechanisms 68, 70, so that the intake valves 12, 14 can be opened or closed with a small lift amount.

(Valve Pause Operation Involving a Small Lift Amount)

Figure 17:
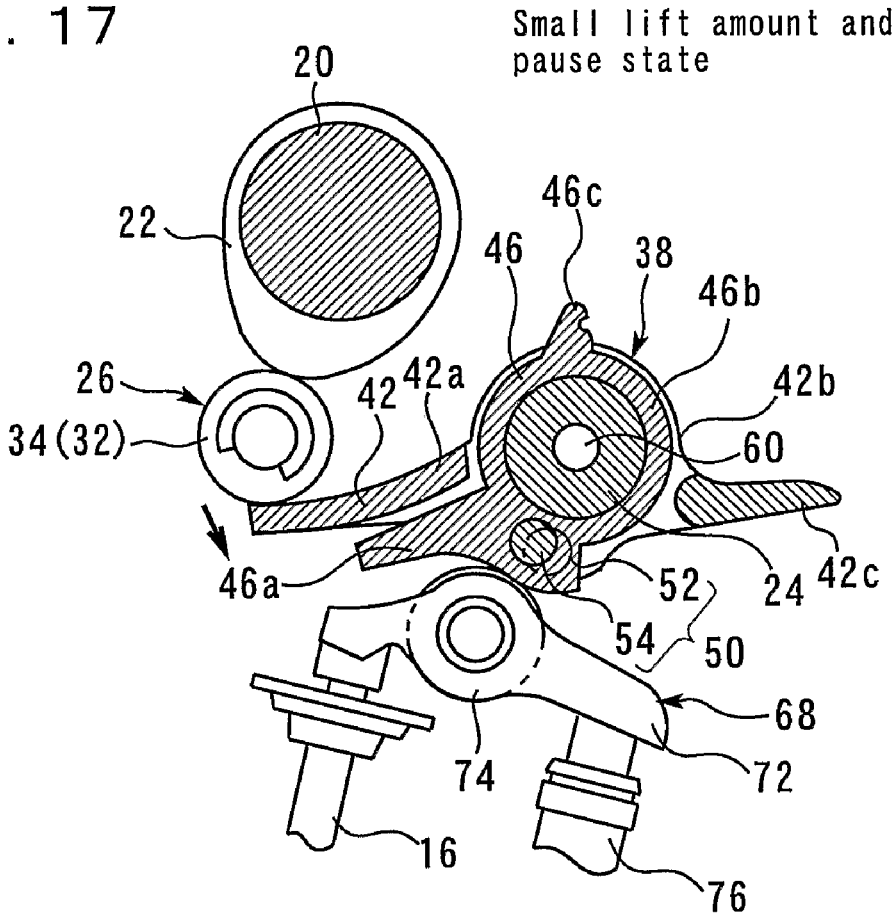
FIG. 17 is a view showing a condition, in which the variable valve apparatus shown in FIG. 15, are brought into a pause state.

FIG. 17 is a view showing a condition, in which the intake valves 12, 14 being opened or closed with a small lift amount are brought into a pause state. To let the intake valves 12, 14 pause, a hydraulic pressure is applied to the oil path 60 as in the case of the large lift amount. As a result, the connection selection mechanism 50 performs the same connection disengagement operation as in the case of the large lift amount. This disconnects the connection between the input arm 42 and the output arm 46, and between the input arm 44 and the output arm 48, respectively, bringing the intake valves 12, 14 to a pause state.

A narrower rocking range θ of the input arms 42, 44 results in the valve pause state involving the small lift amount as compared with the valve pause state involving the large lift amount described earlier (FIG. 14). Consequently, even in this condition, the engagement hole 52 and the movable pin 54 of the connection selection mechanism 50 oppose each other at least at one place within the rocking range θ, substantially in the same manner as in the case of FIG. 14. Accordingly, even in the case of the small lift amount, the movable pin 54 can be engaged with the engagement hole 52 while the drive cam 22 makes one revolution.

[Characteristics of the First Embodiment]

The first embodiment of the present invention provides the arrangement, in which the rocking cam arm disposed between the variable mechanism 26 and the valve actuating mechanisms 68, 70 is formed as the split-type rocking cam arms 38, 40 that achieve a pause state of the intake valves 12, 14. In this case, the connection selection mechanism 50 can connect, or disconnect, the input arms 42, 44 and the output arms 46, 48 regardless of the variable mechanism 26 varying the lift amount of the intake valves 12, 14.

Accordingly, the connection selection mechanism 50 can quickly bring the intake valves 12, 14 operating with any given lift amount to a pause state. The connection selection mechanism 50 can also quickly return the intake valves 12, 14 in the pause state to any given lift amount. Specifically, the connection selection mechanism 50 can smoothly effect pause and return operations of the intake valves 12, 14 regardless of whether the lift amount is large or small. There is therefore no need to go through unnecessary lift amounts as in the known art when bringing the intake valves 12, 14 to a pause or returning the intake valves 12, 14 therefrom. This permits smooth control of the lift amount and improves control response.

In the first embodiment of the present invention, the input arms 42, 44 and the output arms 46, 48 are rockably mounted on the outer peripheral side of the control shaft 24. This allows the input arms 42, 44 and the output arms 46, 48 to be integrally or individually rocked about the control shaft 24. By using the control shaft 24 as a pivot, therefore, the rocking cam arms 38, 40 capable of being connected and disconnected can be compactly disposed on the outer peripheral side of the control shaft 24.

The foregoing arrangement eliminates the need for complicated link parts or the like for selecting power drive transmission between the drive cam 22 and the valve actuating mechanisms 68, 70. This helps simplify the structure, and promote reduction in size, of the entire system. Further, the embodiment of the present invention may be applicable to the variable valve apparatus incorporating the known rocking cam arm by simply changing the rocking cam arm may to the split type. The embodiment of the present invention can therefore be applied by making only small-scale changes.

The input arm 42 and the output arm 46, which constitute the rocking cam arm 38 on the first side, are shaped symmetrically on both axial sides about the plane P extending perpendicularly to the control shaft 24. Accordingly, the intermediate roller 34, the abutment portions 42*a*, 46*a*, and the rocker roller 74 can be disposed linearly not being inclined (deviated) relative to the control shaft 24. This also allows the support portions 42*b*, 46*b* to support the abutment portions 42*a*, 46*a* at positions symmetrical about the above-referenced members on both sides thereof.

When the input of the drive cam 22 is applied to the rocking cam arm 38, the foregoing arrangement prevents, for example, any torsional force or moment from acting on the rocking cam arm 38. Accordingly, play in parts constituting the rocking cam arm 38 or reduction in durability of those parts can be suppressed, thus enhancing rigidity. Force by the rocking cam arm 38 can therefore be stably and efficiently transmitted. The foregoing effects can likewise be achieved by the rocking cam arm 40 on the second side having the identical arrangements as the rocking cam arm 38 on the first side.

In accordance with the first embodiment of the present invention, the variable mechanism 26 is disposed between the valve mechanism on the first side (the intake valve 12, the rocking cam arm 38, valve actuating mechanism 68, and the like) and the valve mechanism on the second side (the intake valve 14, the rocking cam arm 40, valve actuating mechanism 70, and the like). This arrangement allows the variable mechanism 26 to receive the input of the drive cam 22 with the center cam roller 32 and to transmit the input to the rocking cam arms 38, 40 on the first and the second sides, respectively, with the intermediate rollers 34, 36 on both sides.

This allows the variable mechanism 26 to perform power drive transmission from the drive cam 22 to the rocking cam arms 38, 40 on both sides in a well-balanced manner through a symmetrical path. Not being subject to torsional force or moment as a whole, the variable mechanism 26 can therefore perform power transmission in a stable manner. In addition, the lift amount of the two valve mechanisms can be varied using the single variable mechanism 26, which helps build the variable valve apparatus 10 having the plurality of intake valves 12, 14 compactly.

An arrangement is also made, in which the movable pin 54 of the connection selection mechanism 50 is normally engaged with the engagement hole 52 by the spring force of the retention spring 56 and, when the hydraulic pressure is supplied to the engagement hole 52, the engagement is canceled. This arrangement permits the following. Specifically, when the internal combustion engine is started, the input arms 42, 44 and the output arms 46, 48 can be held in the connected state, allowing the intake valves 12, 14 to perform the ordinary open/close operations. Accordingly, the internal combustion engine can be normally started even if the preceding operation thereof has been terminated with the valves in the pause state, so that operation control upon starting can be smoothly performed.

The connection selection mechanism 50 is formed to include the engagement hole 52, the movable pin 54, the retention spring 56, the piston 58, and the like. This achieves the connection selection mechanism 50 of a simple structure of engaging and disengaging the movable pin 54 with/from the engagement hole 52. The connection selection mechanism 50 can thereby be compactly disposed in the split-type rocking cam arms 38, 40.

An arrangement is further made, in which the engagement hole 52 and the movable pin 54 of the connection selection mechanism 50 oppose each other at least at one place within the rocking range θ of the input arms 42, 44. This arrangement permits the following. Specifically, when the intake valves 12, 14 are to be returned from the pause state, the movable pin 54 can be engaged with the engagement hole 52 within such a short period of time that the drive cam 22 makes about one revolution after the selection operation is performed for return. Accordingly, the intake valves 12, 14 can be quickly returned to any given lift amount from the pause state.

Further, the connection selection mechanism 50 is disposed between the input arms 42, 44 and the output arms 46, 48, and the outer support portions 42*b*, 44*b* of the input arms 42, 44 include the oil path 62 supplying the connection selection mechanism 50 with the hydraulic pressure. This eliminates the need, for example, for disposing the connection selection mechanism 50 in the variable mechanism 26 having a relatively complicated structure, or disposing the oil path 62 in the variable mechanism 26. Accordingly, a space for disposing the connection selection mechanism 50 and the oil path 62 can be easily found, helping simplify the structure of the variable valve apparatus 10.

The variable valve apparatus 10 according to the first embodiment of the present invention is adapted to include the lost motion spring 64 and the auxiliary spring 66. The lost motion spring 64 can therefore make the input arms 42, 44 press the intermediate rollers 34, 36, and can make the cam roller 32 press the drive cam 22. This makes the rollers 32, 34, 36 and the input arms 42, 44 follow the profile of the drive cam 22 to operate smoothly.

The auxiliary spring 66, on the other hand, can urge the output arms 46, 48 toward the valve actuating mechanisms 68, 70. Accordingly, the auxiliary spring 66 can prevent any play or the like in the output arms 46, 48 that are placed in a free state on the periphery of the control shaft 24 when connection between the input arms 42, 44 and the output arms 46, 48 is canceled.

Second Embodiment

Figure 18:
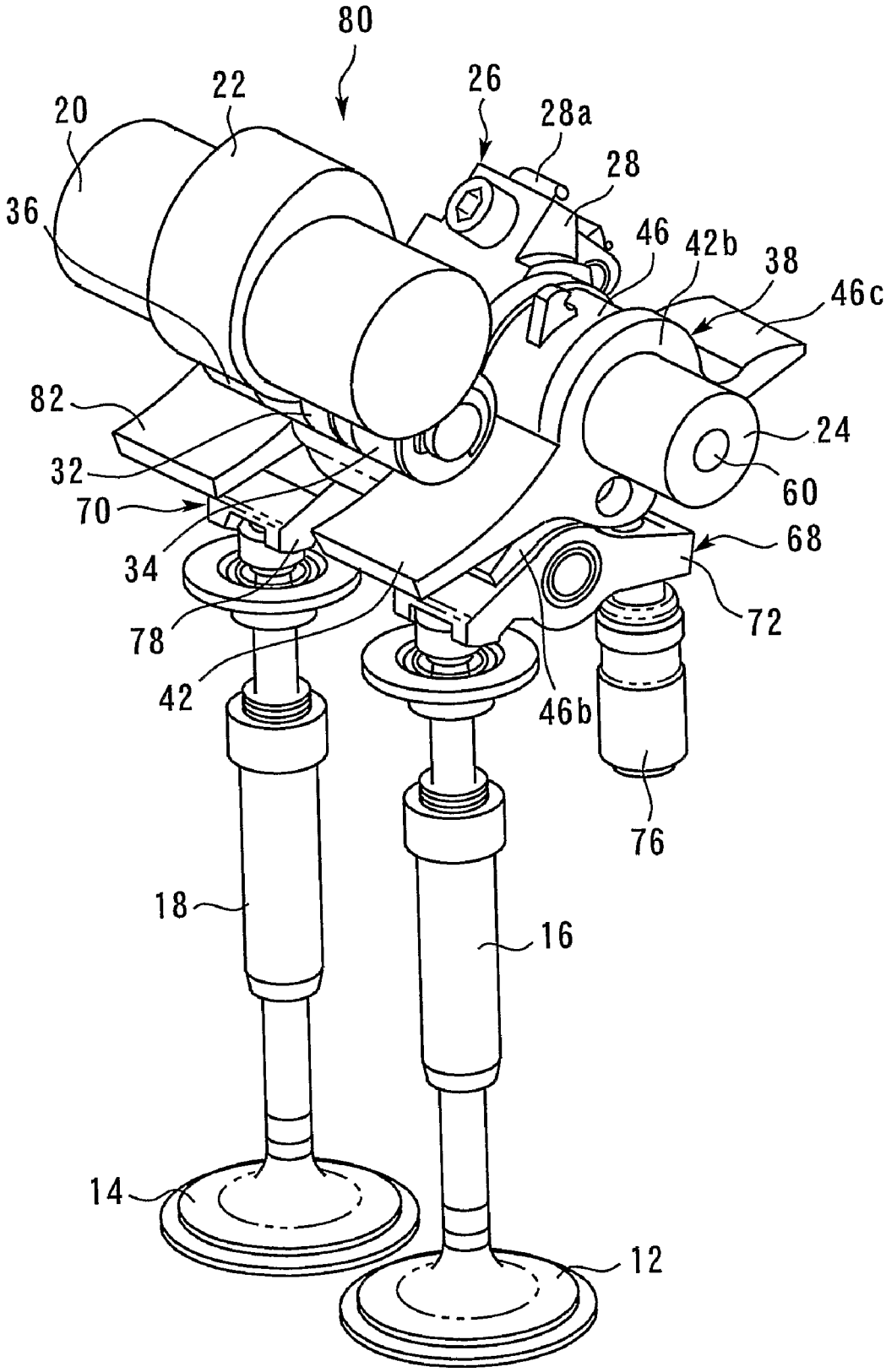
FIG. 18 is a perspective view showing a general arrangement of a variable valve apparatus according to the second embodiment of the present invention.

A variable valve apparatus according to a second embodiment of the present invention will be described below with reference to FIG. 18. In the second embodiment, like reference numerals are assigned to like elements of the first embodiment and descriptions for the same are omitted.

[Characteristics of the Second Embodiment]

A variable valve apparatus 80 according to the second embodiment of the present invention is constructed substantially in the same manner as the first embodiment. The variable valve apparatus 80 includes intake valves 12, 14, a drive cam 22, a control shaft 24, a variable mechanism 26, a split-type rocking cam arm 38 on a first side, a connection selection mechanism on a first side (not shown), valve actuating mechanisms 68, 70, and the like. The variable valve apparatus 80 differs in arrangements from the first embodiment of the present invention in that the variable valve apparatus 80 has a non-split-type rocking cam arm 82, instead of the split-type rocking cam arm 40 on the second side incorporated in the first embodiment.

The non-split-type rocking cam arm 82 is integrally formed from, for example, a metal material, rockably disposed on an outer peripheral side of the control shaft 24. When the non-split-type rocking cam arm 82 operates, therefore, the entire cam arm 82 makes a rocking motion integrally about the control shaft 24. Accordingly, the non-split-type rocking cam arm 82 can transmit, at all times, an input of the drive cam 22 to the valve actuating mechanism 70 on the second side.

In the second embodiment of the present invention having the arrangements as described above, too, substantially the same effect can be achieved as in the first embodiment for the split-type rocking cam arm 38. The rocking cam arms 38, 82, being disposed on both sides of the variable mechanism 26, permit power drive transmission from the drive cam 22 to the valve actuating mechanisms 68, 70 on both sides in a well-balanced manner.

Particularly noteworthy about the second embodiment of the present invention is that the rocking cam arm on the second side is formed as the non-split-type rocking cam arm 82. Accordingly, if a connected state of the split-type rocking cam arm 38 on the first side is canceled, the intake valve 14 on the second side can perform ordinary open/close operations with the intake valve 12 on the first side set in a closed pause state.

As a result, in accordance with the second embodiment of the present invention, only an intake port on a first side of two intake ports disposed in a combustion chamber of an internal combustion engine can be held in a closed position by the intake valve 12. At an intake port on a second side, air can be drawn into the combustion chamber as the intake valve 14 opens and closes. Consequently, swirl control or the like that generates a swirl flow of an intake air in the combustion chamber can be easily performed and the variable valve apparatus 80 to be applicable to the swirl control can be achieved.

In the first and second embodiments of the present invention described heretofore, the intake valves 12, 14 represent specific examples of the valve body and the split-type rocking cam arms 38, 40 represent specific examples of the split-type rocking mechanism. The non-split-type rocking cam arm 82 represents a specific example of the non-split-type rocking mechanism. The input arms 42, 44 and the output arms 46, 48 represent specific examples of the input member and the output member, respectively. The intermediate roller abutment portions 42*a*, 44*a* and the rocker roller abutment portions 46*a*, 48*a* represent specific examples of the input side abutment portion and the output side abutment portion according to the fourth aspect of the present invention, respectively. The retention spring 56 represents a specific example of the retention means according to the eighth aspect of the present invention and the piston 58 represents a specific example of the disengagement means, respectively. Further, the lost motion spring 64 and the auxiliary spring 66 represent specific examples of the input side urge means and the output side urge means, respectively, according to the eleventh aspect of the present invention.

In accordance with the first embodiment of the present invention, the input arms 42, 44 each include the engagement hole 52 of the connection selection mechanism 50 and the movable pin 54 is disposed in the output arms 46, 48. The present invention is not limited to this arrangement and the output arms 46, 48 may include the engagement hole 52 and the movable pin 54 may be disposed in the input arms 42, 44. In this case, the output arms 46, 48 may include oil paths for supplying the connection selection mechanism 50 with the hydraulic pressure as may be necessary.

The first embodiment of the present invention has been described using, as an example, the connection selection mechanism 50 that is a hydraulically operated type performing the selection operation according to the status of the hydraulic pressure supply. The present invention is not limited to this arrangement; rather, the connection selection mechanism may be of an electrically operated type performing the selection operation according to, for example, the status of energization.

In accordance with the first and second embodiments of the present invention, the variable valve apparatus 10, 80 are adapted to open and close the intake valves 12, 14. The present invention is not limited to the disclosed embodiments; rather, an arrangement may be made, for example, to have the variable valve apparatus open or close a single valve body, or three or more valve bodies.

In accordance with the first and second embodiments of the present invention, the variable valve apparatus 10, 80 are applied to the intake valves 12, 14 of the internal combustion engine. The present invention is not limited to the disclosed embodiments; rather, the variable valve apparatus 10, 80 may still be applied to an exhaust valve of the internal combustion engine. Further, the present invention may be applicable to a wide range of valve bodies mounted in machines of various kinds, not limited only to the internal combustion engine.

The invention claimed is:

1. A variable valve apparatus comprising:

a control shaft rotated for controlling a lift amount of a valve body;

a variable mechanism disposed displaceably near a drive cam, the variable mechanism following a profile of the drive cam at a position corresponding to a rotating angle of the control shaft to make a reciprocating motion;

a split-type rocking mechanism including an input member receiving the reciprocating motion of the variable mechanism to make a rocking motion and an output member outputting the rocking motion of the input member, the input member and the output member being mutually connectable or disconnectable;

a connection selection mechanism selecting a connected or disconnected state between the input member and the output member of the split-type rocking mechanism; and a valve actuating mechanism translating the rocking motion outputted from the output member of the split-type rocking mechanism to a corresponding open or close operation of the valve body, and wherein the split-type rocking mechanism is formed symmetrically on both sides about a plane perpendicular to the control shaft.

2. The variable valve apparatus according to claim 1, wherein the input member and the output member of the split-type rocking mechanism are rockably mounted on an outer peripheral side of the control shaft.

3. The variable valve apparatus according to claim 1, wherein the valve body, the split-type rocking mechanism, the connection selection mechanism, and the valve actuating mechanism are each disposed on a first side and a second side of the control shaft in an axial direction of the control shaft; and wherein the variable mechanism includes an arm portion disposed on the outer peripheral side of the control shaft between the split-type rocking mechanism on the first side and the split-type rocking mechanism on the second side, a cam roller disposed at a leading end side of the arm portion, the drive cam abutting against the cam roller, and two intermediate rollers disposed at the leading end side of the arm portion on both sides of the cam roller, each of the two intermediate rollers abutting against the split-type rocking mechanism on the first side and the split-type rocking mechanism on the second side, respectively.

4. The variable valve apparatus according to claim 1, wherein the valve body, the split-type rocking mechanism, the connection selection mechanism, and the valve actuating mechanism are disposed on a first side of the control shaft in an axial direction of the control shaft;

the valve body and the valve actuating mechanism, together with a non-split-type rocking mechanism, are disposed on a second side of the control shaft in the axial direction of the control shaft; and wherein the variable mechanism includes an arm portion disposed on the outer peripheral side of the control shaft between the split-type rocking mechanism on the first side and the non-split-type rocking mechanism on the second side, a cam roller disposed at a leading end side of the arm portion, the drive cam abutting against the cam roller, and two intermediate rollers disposed at the leading end side of the arm portion on both sides of the cam roller, each of the two intermediate rollers abutting against the split-type rocking mechanism on the first side and the non-split-type rocking mechanism on the second side, respectively.

5. The variable valve apparatus according to claim 1, wherein the connection selection mechanism normally retains a connected state between the input member and the output member and cancels the connected state when driven externally.

6. The variable valve apparatus according to claim 5, wherein the valve body is mounted in an internal combustion engine; and wherein the connection selection mechanism is driven by a hydraulic pressure generated when the internal combustion engine operates.

7. The variable valve apparatus according to claim 6, wherein the connection selection mechanism includes:

an engagement hole disposed in either one of the input member and the output member;

a movable pin displaceably disposed in the other one of the input member and the output member, the movable pin being engaged with or disengaged from the engagement hole;

a retention means normally retaining the movable pin in a state of being engaged with the engagement hole; and a disengagement means disengaging the movable pin from the engagement hole against the retention means when a hydraulic pressure is supplied.

8. The variable valve apparatus according to claim 7, wherein the engagement hole and the movable pin are disposed at positions, at which each opposes each other, when the input member and the output member make a rocking motion relative to each other, within a range of the rocking motion.

9. The variable valve apparatus according to claim 1, wherein the connection selection mechanism is a hydraulically-operated mechanism disposed between the input member and the output member;

wherein the control shaft includes a first oil path, to which a hydraulic pressure is supplied from a hydraulic pressure source; and wherein the split-type rocking mechanism includes a second oil path connected with the first oil path, the second oil path supplying the connection selection mechanism with the hydraulic pressure.

10. The variable valve apparatus according to claim 1, wherein the split-type rocking mechanism includes an input side urge means urging the input member toward the variable mechanism and an output side urge means urging the output member toward the valve actuating mechanism.

* * * * *